US007973000B2

(12) United States Patent
Shitara et al.

(10) Patent No.: US 7,973,000 B2
(45) Date of Patent: Jul. 5, 2011

(54) SEMI-SOLID LUBRICANT COMPOSITION FOR TRANSMISSION ELEMENT AND MECHANICAL SYSTEM PROVIDED WITH THE SAME

(75) Inventors: Yuji Shitara, Saitama (JP); Koichi Yoshida, Saitama (JP)

(73) Assignee: Japan Energy Corporation, Tokyo (JP)

( * ) Notice: Subject to any disclaimer, the term of this patent is extended or adjusted under 35 U.S.C. 154(b) by 321 days.

(21) Appl. No.: 12/294,405

(22) PCT Filed: Mar. 23, 2007

(86) PCT No.: PCT/JP2007/055945

§ 371 (c)(1),
(2), (4) Date: Oct. 10, 2008

(87) PCT Pub. No.: WO2007/116642

PCT Pub. Date: Oct. 18, 2007

(65) Prior Publication Data

US 2009/0176668 A1 Jul. 9, 2009

(30) Foreign Application Priority Data

Mar. 24, 2006 (JP) ..... 2006-081922
Mar. 24, 2006 (JP) ..... 2006-081955

(51) Int. Cl.
*C10M 133/16* (2006.01)

(52) U.S. Cl. ..... 508/551; 508/515; 508/513; 508/123

(58) Field of Classification Search ..... 508/515, 508/123, 551, 513
See application file for complete search history.

(56) References Cited

U.S. PATENT DOCUMENTS

| | | | | |
|---|---|---|---|---|
| 2,594,286 | A * | 4/1952 | Bryant et al. | 508/555 |
| 6,100,226 | A * | 8/2000 | Konzman et al. | 508/423 |
| 2003/0069147 | A1 | 4/2003 | Kawamura et al. | |
| 2006/0111256 | A1 * | 5/2006 | Kinoshita et al. | 508/552 |

FOREIGN PATENT DOCUMENTS

| | | |
|---|---|---|
| DE | 102 61 115 | 7/2004 |
| EP | 1 559 773 | 8/2005 |
| EP | 1 803 792 | 7/2007 |

(Continued)

OTHER PUBLICATIONS

European Search Report—EP 07 73 7386—Aug. 2, 2010.

*Primary Examiner* — Glenn Caldarola
*Assistant Examiner* — Jim Goloboy
(74) *Attorney, Agent, or Firm* — Young & Thompson

(57) ABSTRACT

A semi-solid lubricant composition for transmission elements which is excellent in lubricity, antiwear properties, and energy-saving performance, has high reliability, and is for use as a turbine oil, machine tool oil, metal working oil, plastic working oil, cutting oil, compressor oil, vacuum-pump oil, electrical-contact oil, grease, or machine oil; and a mechanical system provided with the composition. The composition, which reduces the wear of sliding parts of a transmission element, comprises: an amide compound having one or two amide groups and forming a three-dimensional network structure; and a liquid base oil ingredient having a dynamic viscosity at 100° C. of 25 $mm^2/s$ or lower and a viscosity index of 120 or higher. The composition contains substantially no ingredients other than the amide compound and liquid base oil ingredient. The mechanical system has a transmission element including sliding parts which are provided with the semi-solid lubricant composition for transmission elements.

17 Claims, 1 Drawing Sheet

(a)

(b)

(c)

FOREIGN PATENT DOCUMENTS

| | | | |
|---|---|---|---|
| GB | 859218 | * | 1/1961 |
| JP | 50-27047 | | 9/1975 |
| JP | 51-125677 | | 11/1976 |
| JP | 56-53194 | | 5/1981 |
| JP | 2-6599 | | 1/1990 |
| JP | 8-337790 | | 12/1996 |
| JP | 10279974 | | 10/1998 |
| JP | 2003-27079 | | 1/2003 |
| JP | 2004-339434 | | 12/2004 |
| JP | 2005-139398 | | 6/2005 |
| JP | 2006/51671 | | 5/2006 |
| WO | WO 2004009746 A1 | * | 1/2004 |

* cited by examiner (a)

(b)

(c)

SEMI-SOLID LUBRICANT COMPOSITION FOR TRANSMISSION ELEMENT AND MECHANICAL SYSTEM PROVIDED WITH THE SAME

TECHNICAL FIELD

The present invention relates to a semisolid lubricant composition for a transmission element and a mechanical system provided with the composition. The composition lubricates a transmission element, which can mechanically transmit power, such as a gear, a moving screw, a cam, a belt, a chain, a wire rope, and the like, and can be used as an alternative lube oil which is substituted to particularly a turbine oil, a machine tool oil, a metal working oil, a forming oil, a cutting oil, a compressor oil, a vacuum-pump oil, an electrical-contact oil, or a machine oil.

BACKGROUND ART

Not only high reliability, but also resource-saving and energy-saving properties are strongly demanded for vehicles, construction equipment, agricultural implements, trains, airplanes, vessels, electrical home appliances, OA equipment, precision instruments, and the like. In order to assemble these machines and manufacture or process the parts thereof and the like, various mechanical systems such as a plastic processing instrument, a machine tool, an injection molding machine, a pressing machine, a forge rolling machine, a grinding machine, a compressor, a vacuum pump, and the like are used. Capability of implementing high precision processing, high reliability, and resource-saving and energy-saving properties are demanded for these mechanical systems. Furthermore, a gear, a moving screw, a cam, a belt, a chain, a wire rope, and the like which are the transmission machine elements to mechanically transmit power by means of a sliding movement, friction, lubrication, and the like are used in these mechanical systems. Various kinds of lubricating oils, lubricants, greases, solid lubricants and the like, which are also called turbine oil, machine tool oil, metal working oil, forming oil, cutting oil, compressor oil, vacuum-pump oil, electrical-contact oil, or machine oil, are used individually or in combination of two or more depending on the various applications thereof. High reliability, excellent lubricity, energy saving properties, and harmlessness to environment are desired for lubricating oils and greases used for these mechanical systems.

As a grease, a composition blending a liquid base oil such as a mineral oil, a synthetic oil (e.g. a poly-α-olefin, a silicone oil, a fluorinated ether, a fatty acid ester, and the like), or a vegetable oil, and a thickener such as a metal soap or an urea compound is mainly used.

[Patent Document 1] JP-B-S50-27047
[Patent Document 2] JP-A-S58-53991
[Patent Document 3] JP-A-S56-53194
[Patent Document 4] JP-A-S56-32594
[Patent Document 5] JP-A-H06-116581
[Patent Document 6] JP-A-2000-2300186

DISCLOSURE OF THE INVENTION

Problems to be Solved by the Invention

The inventors of the present invention have previously proposed a heat-reversible gel-like lubricant composition comprising a mineral oil and/or synthetic liquid lubricant base oil, a bisamide and/or monoamide, and further a friction conditioner (WO 2006/051671).

In recent years, however, since it has been strongly desired for the above-mentioned mechanical systems to provide with higher functions, miniaturization, and longer life, the lubricant has been required a further higher performance, particularly, to exhibit excellent energy saving performance and be capable of lubricating with minimal abrasion while using a very small amount of oil.

Therefore, an object of the present invention is to provide a semisolid lubricant composition for a transmission element having a low coefficient of friction and excellent anti-wear properties, which has excellent lubricity, anti-wear properties, and energy saving performance, has high reliability, and can be used as an alternative for turbine oil, machine tool oil, metal working oil, forming oil, cutting oil, compressor oil, vacuum-pump oil, electrical-contact oil, grease, or machine oil; and a mechanical system provided with the composition.

Means for Solving the Problems

The inventors of the present invention have found that a lubricant composition which contains a heat-reversible semisolid substance, while exhibiting the same semisolid state and hardness as that possessed by a common grease, exhibits superior lubricity as compared with grease, specifically better anti-wear properties, a longer life, and a lower coefficient of friction. In addition, the inventors have found that the lubricant composition can contribute to reduction of friction resistance and thus promotion of energy-saving in various applications. Differing from common greases, the composition can repeatedly change state to liquid from semisolid and vice versa on many occasions by heating and cooling, while maintaining basic properties such as lubricity. Utilizing these properties, it is possible to subject the lubricant composition of the present invention to microfiltration in a liquid state with heating to remove very fine dust and foreign matter and to produce a highly purified lubricant composition.

The lubricant composition obtained in this manner may be suitably used in a precise mechanical system with narrow clearances. These findings have led to the completion of the present invention.

Specifically, the present invention provides the following semisolid lubricant composition for a transmission element and a mechanical system provided with the composition.

(1) A semisolid lubricant composition for a transmission element capable of reducing wear of sliding portions of the transmission element comprising an amide compound having one or two amide groups and forming a three-dimensional network structure, and a liquid base oil component having a kinetic viscosity at 100° C. of 25 $mm^2/s$ or lower and a viscosity index of 120 or higher, wherein the composition substantially contains no component other than the amide compound and the liquid base oil component.

(2) The composition according to (1), wherein a component other than the amide compound and the liquid base oil component is a polymer having a molecular weight of 1000 or more, and the content thereof is 3 mass % or less.

(3) The composition according to (1), wherein the amide compound is at least one compound represented by any one of the following formulas (1) to (3) and the content thereof is 0.1 to 70 mass %, $$R^1—CO—NH—R^2 \quad (1)$$

$$R^3—CO—NH-A^1-NH—CO—R^4 \quad (2)$$

$$R^5—NH—CO-A^2-CO—NH—R^6 \quad (3)$$

wherein $R^1$, $R^3$, $R^4$, $R^5$, and $R^6$ individually represent a saturated or unsaturated linear hydrocarbon group having 5 to 25 carbon atoms, $R^2$ represents hydrogen or a saturated or unsaturated linear hydrocarbon group having 5 to 25 carbon atoms, and $A^1$ and $A^2$ individually represent a divalent hydrocarbon group having 1 to 10 carbon atoms selected from an alkylene group having 1 to 10 carbon atoms, a phenylene group, and an alkylphenylene group having 7 to 10 carbon atoms.

(4) The composition according to (1), wherein the liquid base oil component is at least one synthetic oil selected from a poly-α-olefin, a fatty acid ester, and a silicone oil.

(5) The composition according to (1), wherein the transmission element is at least one transmission element selected from a gear, a moving screw, and a chain.

(6) A mechanical system comprising at least one transmission element selected from a gear, a moving screw, and a chain provided with the composition according to any of (1) to (5) in a sliding portion thereof.

Effect of the Invention

Since the semisolid lubricant composition for a transmission element of the present invention comprises a specific amide compound and a liquid base oil component, the composition is liquid during operation of the mechanical system due to temperature increase in the sliding portions and serves as a liquid lubricating oil agent exhibiting good lubricity (high anti-wear property and a low coefficient of friction), but during non-operation, or in the area apart from the sliding portions, the composition is cooled and remains semisolid. Therefore, in addition to good lubricity, excellent energy-conservation, and long life, the composition exhibits an effect of preventing pollution of surrounding due to oil leakage, oil dripping, and the like.

BRIEF DESCRIPTION OF THE DRAWING

FIGS. 1(*a*), 1(*b*), and 1(*c*) respectively show photographs taken in Example 1, Comparative Example 1, and Comparative Example 2.

BEST MODE FOR CARRYING OUT THE INVENTION

Amide Compound

Figure 1:
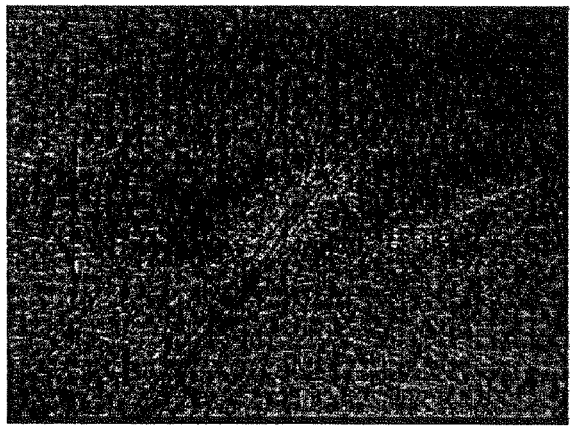
FIG. 1 shows photographs of wear track produced on disks after carrying out an SRV friction test of lubricant compositions taken by a microscope (magnification: about 30 times).
Figure 1:
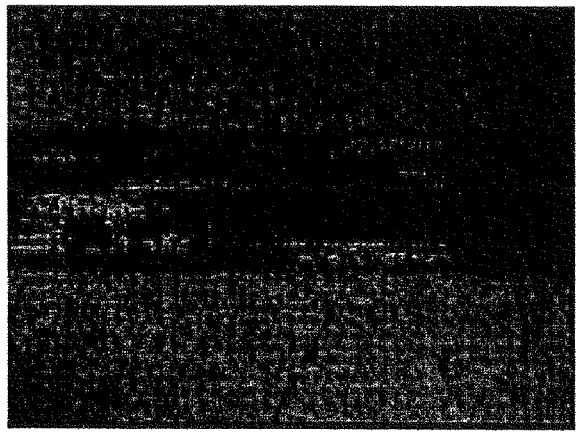
Figure 1:
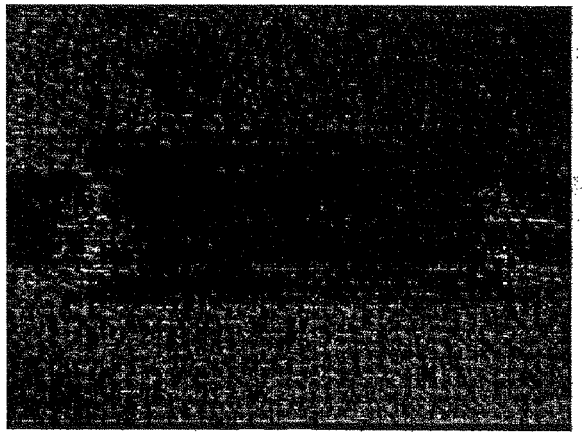

The amide compound used in the present invention is a gel-like compound which contains one or two amide groups and forms a three-dimensional network structure, and the amide compound is a semi-solidifying component which forms a semisolid material (the semisolid lubricant composition for a transmission element of the present invention) by mixing with a liquid base oil component. For example, a fatty acid monoamide, a fatty acid bisamide, and a mixture of these amides are preferably used. Furthermore, a fatty acid triamide which is a compound having three amide groups may be used.

Fatty acid monoamide which is a compound containing one amide group is shown by the following formula (1), $$R^1\text{—CO—NH—}R^2 \quad (1)$$

wherein $R^1$ is a saturated or unsaturated linear hydrocarbon group having 5 to 25 carbon atoms and $R^2$ is hydrogen or a saturated or unsaturated linear hydrocarbon group having 5 to 25 carbon atoms. The hydrogen atoms on the linear hydrocarbon group may be partially substituted with a group such as a hydroxyl group and the like to the extent not impairing the effect of the present invention.

Specifically, the monoamide may include saturated fatty acid amides such as lauric acid amide, palmitic acid amide, stearic acid amide, behenic acid amide and hydroxy stearic acid amide, unsaturated fatty acid amides such as oleic acid amide and erucic acid amide, or substituted amides of long-chain fatty acid and long-chain amine (monoamide of the formula above in which $R^2$ is not hydrogen) such as stearyl stearic acid amide and oleyl oleic acid amide. However, taking into consideration of being used at high temperature, the substituted amide having a molecular weight close to that of a bisamide is preferable. The melting point of the monoamide favorably used is preferably 50 to 200° C., and particularly preferably 80 to 180° C., and the molecular weight of the monoamide is preferably 100 to 1000, and particularly preferably 150 to 800.

The fatty acid bisamide which is a compound having two amide groups may be either a diamine acid amide or a diacid acid amide. The melting point of the bisamide favorably used is preferably 80 to 250° C., and particularly preferably 100 to 200° C., and the molecular weight of the bisamide is preferably 240 to 2000, and particularly preferably 290 to 1500.

A suitable acid amide of diamine used for the present invention is shown by the following formula (2), $$R^3\text{—CO—NH-}A^1\text{-NH—CO—}R^4 \quad (2)$$

wherein $R^3$ and $R^4$ individually represent a saturated or unsaturated linear hydrocarbon group having 5 to 25 carbon atoms, $A^1$ is a divalent hydrocarbon group having 1 to 10 carbon atoms selected from an alkylene group having 1 to 10 carbon atoms, a phenylene group, and an alkylphenylene group having 7 to 10 carbon atoms.

A suitable diacid acid amide is shown by the following formula (3), $$R^5\text{—NH—CO-}A^2\text{-CO—NH—}R^6 \quad (3)$$

wherein $R^5$ and $R^6$ individually represent a saturated or unsaturated linear hydrocarbon group having 5 to 25 carbon atoms, $A^2$ is a divalent hydrocarbon group having 1 to 10 carbon atoms selected from an alkylene group having 1 to 10 carbon atoms, a phenylene group, and an alkylphenylene group having 7 to 10 carbon atoms.

The diamine acid amide is preferably ethylene bisstearic acid amide, ethylene bisisostearic acid amide, ethylene bisoleic acid amide, methylene bislauric acid amide, hexamethylene bisoleic acid amide, hexamethylene bishydroxy stearic acid amide, m-xylylene bisstearic acid amide, and the like. The diacid acid amide is preferably N,N'-distearic sebacic acid amide or the like. Of these, ethylene bisstearic acid amide is particularly preferable.

A compound shown by the following formula (4) may be used as a fatty acid triamide which is a compound containing three amide groups, $$R^7\text{-M-}A^3\text{-CH}(A^4\text{-M-}R^8)\text{-}A^5\text{-M-}R^9 \quad (4)$$

wherein $R^7$, $R^8$, and $R^9$ are independently saturated or unsaturated linear hydrocarbon groups with 2 to 25 carbon atoms, an alicyclic hydrocarbon group, or an aromatic hydrocarbons group, M is an amide group (—CO—NH—), and $A^3$, $A^4$, and $A^5$ individually represent a single bond or an alkylene group having 5 or less carbon atoms.

There are a large number of compounds shown by the formula (4). As specific compounds which can be suitably used in the present invention, an N-acylamino acid diamide compound can be specifically given. The N-acyl group of the compound is preferably a linear or branched saturated or branched aliphatic acyl group or aromatic acyl group having 1 to 30 carbon atoms, and particularly preferably a caproyl group, a capryloyl group, a lauroyl group, a miristoyl group, or a stearoyl group. The amino acid of the compound preferably includes aspartic acid or glutamic acid. The amine of the amide group is preferably a linear or branched saturated or unsaturated aliphatic amine, aromatic amine, or alicyclic amine with 1 to 30 carbon atoms respectively, and particularly preferably butylamine, octylamine, laurylamine, isostearylamine, stearylamine, cyclohexylamine, or benzylamine. As a particularly preferable compound, N-lauroyl-L-glutamic acid-α,gamma-di-n-butylamide can be specifically given.

[Liquid Base Oil Component]

In the present invention, a liquid base oil component with a kinetic viscosity at 100° C. of 25 $mm^2/s$ or less and a viscosity index of 90 or more is preferably used. The kinetic viscosity is more preferably 1.0 to 25 $mm^2/s$, and particularly preferably 1.7 to 25 $mm^2/s$. The viscosity index is more preferably 90 to 160, and particularly preferably 120 to 150. As other properties, pour point is preferably −10° C. or less, and more preferably −20° C. or less, and flash point is preferably 150° C. or more, and more preferably 155° C. or more.

As specific examples of the liquid base oil component, a mineral oil and a synthetic oil such as a poly-α-olefin, an ethylene-α-olefin copolymer, alkylnaphthalene, a fatty acid ester (for example, diester, polyol ester, etc.), an ether (for example, polyalkylene glycol, phenyl ether, fluorinated ether, etc.), silicone oil, fluorinated oil, and the like can be given. The mineral oil and the synthetic oil may be respectively used by appropriately mixing two or more mineral oils, mixing two or more synthetic oils, furthermore, it is possible to use by mixing a mineral oil and a synthetic oil in an appropriate ratio. A product mixed various additives to the liquid base oil component may also be used.

Mineral oil is generally prepared by obtaining a distillate oil by distilling crude oil under atmospheric pressure, or further distilling the atmospheric residual oil under reduced pressure, obtaining a lube oil fraction as a base oil by refining the distillate oil using various refining processes, and adding various additives to the base oil. Examples of the refining processes include hydrorefining, solvent extraction, solvent dewaxing, hydrodewaxing, sulfuric acid treatment, and clay treatment. A mineral lube base oil suitably used for the present invention can be obtained by combining these processes and treating in an appropriate order. A mixture of purified oils having different properties obtained by treating different crude oils or distillate oils through the processes in different combinations and different orders may be used as a suitable base oil.

For the synthetic oil, for example, a poly-α-olefin (PAO), a low-molecular weight ethylene-α-olefin copolymer, alkyl naphthalene, fatty acid ester, ethers, silicone oil, fluorinated oil, and the like having high heat resistance may be used alone or in combination as a base oil. Among the synthetic oils, a poly-α-olefin (PAO) and ethylene-α-olefin copolymer, which are both polymer of olefin monomer and of which the viscosity and other properties can be adjusted by controlling the polymerization degree, can be preferably used as the liquid base oil. PAO prepared by polymerizing an olefin oligomer such as 1-decene, 1-dodecene, and 1-tetradecene with a polymerization degree of 2 to 10, and appropriately blending the resulting polymers to adjust the viscosity (kinetic viscosity at 100° C. of 1 to 25 $mm^2/s$) is preferably used. An ethylene-α-olefin copolymer obtained by copolymerizing ethylene and olefin oligomer having 3 to 10 carbon atoms, and adjusting the kinetic viscosity at 100° C. in a range of 1 to 25 $mm^2/s$ is also preferably used.

The fatty acid ester can be obtained by a dehydration-condensation reaction of an alcohol and a fatty acid. In the present invention, diesters and polyol esters can be given as suitable liquid base oil components from the viewpoint of chemical stability. As a diester, an ester of a dibasic acid having 4 to 14 carbon atoms and an alcohol having 5 to 18 carbon atoms is preferably used. As a dibasic acid, specifically adipic acid, azelaic acid, sebacic acid, undecane diacid, dodecane diacid, and the like can be given, and among them adipic acid, azelaic acid, and sebacic acid are preferable. As an alcohol, a monohydric alcohol with 6 to 12 carbon atoms, particularly a monohydric alcohol having a branched hydrocarbon group having 8 to 10 carbon atoms, is preferable. specifically, 2-ethylhexanol, 3,5,5-trimethylhexanol, decyl alcohol, lauryl alcohol, and oleyl alcohol can be given.

As a polyol ester, an ester of a hindered alcohol, such as neopentyl glycol, trimethylolethane, trimethylolpropane, trimethylolbutane, di-(trimethylolpropane), tri-(trimethylolpropane), pentaerythritol, di-(pentaerythritol), and tri-(pentaerythritol), and a fatty acid with 1 to 24 carbon atoms are preferable. Although there are no specific limitations to the number of carbon atoms of the fatty acid, among the fatty acids having 1 to 24 carbon atoms, those having 3 or more carbon atoms are preferable from the viewpoint of lubricity. Fatty acids having 4 or more carbon atoms are more preferable, those having 5 or more carbon atoms are still more preferable, and those having 7 or more carbon atoms are particularly preferable. Specifically, pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, icosanoic acid, oleic acid, and the like can be given. These fatty acids may be either linear fatty acid or breached fatty acid, further may be a neo acid which is a fatty acid having a quaternary carbon atom at the α-position.

Ethers are organic compounds having an ether bond. Typical esters are shown by the following formula (5) or (6).

$$R^{10}—O-A^{5}-R^{11} \quad (5)$$

wherein $R^{10}$ and $R^{11}$ individually represent hydrogen or an alkyl group having 1 to 8 carbon atoms and $A^6$ represents one or more polymer chain forming with 5 to 300 of alkylene oxide units having 2 to 4 carbon atoms.

$$\begin{array}{l} CH_2—O—A^{7}—R^{12} \\ | \\ CH—O—A^{8}—R^{13} \\ | \\ CH_2—O—A^{9}—R^{14} \end{array} \quad (6)$$

wherein $R^{12}$ to $R^{14}$ individually represent hydrogen or an alkyl group having 1 to 8 carbon atoms and $A^7$ to $A^9$ individually represent one or more polymer chain forming with 5 to 300 alkylene oxide units having 2 to 4 carbon atoms. $R^{10}$ to $R^{14}$ are preferably hydrogen, a methyl group, an isopropyl group, an isobutyl group, or a tert-butyl group, respectively, and particularly preferably all methyl groups. As the alkylene oxide unit represented by $A^6$ to $A^9$, an ethylene oxide unit or a propylene oxide unit is preferable. The polymer chains may be a block copolymer chain, a random copolymer chain, or an alternating copolymer chain. The number of the alkylene oxide units of the polymer chains is determined so that the polyether exhibits a viscosity within a predetermined viscosity range.

As specific examples of the polyether, polyalkylene glycol or a derivative thereof, polyvinyl ether, and the like can be given. Polyalkylene glycol or derivatives thereof and polyvinyl ether having alkyl groups at both ends are preferable.

The polyorganosiloxane which is a silicone has a main chain of Si—O— as shown in the following formula (7). The viscosity of the polyorganosiloxane differs according to the polymerization degree.

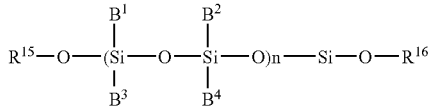

(7)

wherein $R^{15}$ and $R^{16}$ individually represent hydrogen or an alkyl group having 1 to 8 carbon atoms, $B^1$ to $B^4$ individually represent hydrogen, a hydrocarbon group (a methyl group, an isopropyl group, an isobutyl group, a tert-butyl group, a phenyl group, and the like), or a halogen (fluorine, iodine, bromine, etc.). A polyorganosiloxane in which all substituents are a methyl group or a group having a phenyl group for some of the substituents is particularly preferable due to the low price.

Fluorinated oil can be shown by the following formula (8) and formula (9).

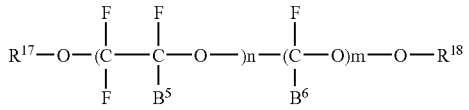

(8)

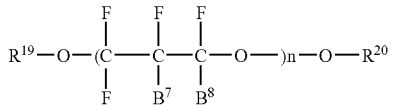

(9)

wherein $R^{17}$, $R^{18}$, $R^{19}$, and $R^{21}$ are individually hydrogen or an alkyl group (having 1 to 6 carbon atoms). $B^5$, $B^6$, $B^7$, and $B^8$ are individually F, $CF_3$, $C_2F_5$, $C_6H_5$, $C_6F_5$, and the like.

[Semisolid Substance]

The term "semisolid" in the present invention refers to a state of a material not exhibiting the same liquid-like fluidity as a conventional grease, but maintaining a certain degree of hardness unless heated to a temperature at which the material is fluidized.

The semisolid lubricant composition for a transmission element of the present invention preferably has a worked penetration of 20 to 475, particularly preferably 40 to 475, and is classified into a hardness falling under the range of the consistency No. 000 to No. 6 applied to greases and exceeding these range, when classified according to the consistency defined in JIS K2220 "grease".

Although not particularly limited, the semisolid substance can be prepared by weighing the prescribed amounts of the liquid base oil component and the amide compound (semisolidification component), heating the mixture at a temperature higher than the melting point of the amide compound while stirring to homogeneously dissolve, and then cooling the mixture to obtain a semisolid product. It is also possible to obtain a semisolid working medium by dissolving the amide compound in a solvent such as an alcohol solvent, a ketone solvent, or a hydrocarbon solvent, adding the solution to a liquid base oil, homogenizing the mixture, and removing the solvent by an appropriate known method. Various additives may also be added to the resulting semisolid medium.

The semisolid lubricant composition of the present invention is characterised in that the composition does not substantially contain a component other than the above-mentioned liquid base oil component and the amide compound (semisolidification component). That is to say, the semisolid lubricant composition does not contain a high molecular compound such as an adhesive and a viscous material, particularly a high molecular weight component with a molecular weight of 1000 or more. Even in the case in which such a high molecular weight component is included, it is preferable that the content be 3 mass % or less at most. As examples of such a high molecular weight component, microcrystalline wax, vaseline, petrolactam, polyisoprene rubber, polyisobutene rubber, and the like can be given.

The semisolid lubricant composition of the present invention can be prepared by mixing a liquid base oil component and a semisolidification component (amide compound) in a ratio by mass of 30:70 to 99.9:0.1. The ratio by mass of the liquid base oil component to the semisolidification component is more preferably 50:50 to 99.5:0.5, and still more preferably 60:40 to 99:1. The semisolid lubricant composition can be formed by mixing the liquid base oil component and the amide compound in the above ratio. The liquid base oil component and the amide compound each may be used alone or may be used in combination with two or more kinds of component or compound in a appropriate ratio.

Since the semisolid lubricant composition of the present invention becomes liquid state when heated to a temperature greater than the melting point of the amide compound, a highly purified lubricant composition with a minimal content of impurities and contaminants can be obtained by microfiltration.

The term "microfiltration" refers to physically filtering using a filter with a filtration pore size of 1 to 10 μm, and removing foreign matter with a size of 5 to 100 μm, which may enter into clearances of various transmission element systems and cause failures on lubricating performance. Therefore, the semisolid lubricant composition highly refined in said manner can be suitably used for a precision instrument system, electronic equipment, and the like with narrow clearances for which a high degree of accuracy is demanded.

[Other Additives]

The semisolid lubricant composition of the present invention can also be prepared by properly blending well-known antioxidants, rust inhibitors, anti-wear agents, extreme pressure agents, oiliness agents, antifoaming agents, metal deactivators, and the like which are commonly used for providing a semisolid substance with the performance as a common lubricant.

[Applicable Systems]

The semisolid lubricant composition of the present invention not only exhibits good lubricity (high anti-wear properties, low coefficient of friction), but also semipermanently repeats the change of state (liquefaction due to a temperature increase and semisolidification (gelation) due to a temperature decrease) by environmental thermal energy. Specifically, in sliding portions of the machine used, because the semisolid lubricant composition is liquid only in a local high-temperature region (for example, at a temperature from 50 to 250° C., or a temperature 20° C. higher than the bulk temperature of the machine), but remains a semisolid (gel) in a bulk temperature region (from room temperature to several tens of centigrade degree, e.g. 0 to 80° C.), the composition can prevent pollution of surrounding due to oil leakage, oil dropping, and the like.

Therefore, the composition can be used for the following applications, including the applications for which grease has been used heretofore. For example, the composition is used for lubricating portion of a turbine power generator or various accessories in power plants such as a hydraulic power plant, a thermal power plant, and an atomic power plant. The composition can also be used in various industrial mechanical systems in metalworking represented by ironworks, for example, in table rollers, chain drives, gear couplings of a rolling mill, a plastic processing machine, and the like, and for lubricating precision drive mechanism portions such as a moving screw, a gear, a belt, a chain, and the like in a machine tool, an injection molding machine, a pressing machine, a forge rolling machine, a grinding machine, and the like. The composition of the present invention may further be used in portions of transportation systems in which grease lubrication is used. As examples of lubricating portions of vehicles, a power train system such as a constant velocity joint and a universal joint, portions around the engine such as an actuator, a starter, a gear, an alternator, a spline, and an overrunning clutch, portions around the steering such as a rack & pinion and tilt-telescope, a ball joint mechanism of suspension, braking system and chassis, a door handle, a door check, a door hinge, a door-lock actuator, a door ratchet, a key cylinder, an power mirror, a seat belt, a seat, a window regulator, and various switches can be given. Chain driving portions of a motorcycle and a bicycle; guide bushing portions of construction machine such as a hydraulic excavator, a wheel loader, a bulldozer, and a crane; and gear portions and chain driving portions of an agricultural implement and machinery, a mower, and a chain saw are also given as objects in which the composition of the present invention is suitably used. In the railroad system, the composition is suitably used in a gear box, a railroad turn-out switch, and the like. Gears and sliding portions of an airplane and a vessel can also be given as objects in which the composition of the present invention is suitably used.

Furthermore, as a familiar mechanical system, sliding portions of a rotating machine which drives a recording medium such as FD, CD, DVD, a magnetic tape, a digital tape, and the like; sliding portions of OA equipment such as a printer, a facsimile, and a copying machine and electrical home appliances such as an air conditioner, a refrigerator, a vacuum cleaner, a microwave oven, a washing machine, and a massage machine; and a hard disk drive section in a computer, shutter mechanism and a lens drive section of a film camera and a digital camera, and sliding section of a clock can be given as suitable objects in which the highly refined lubricant composition obtained by microfiltration of the present invention can be suitably used. The composition can also be used as vacuum grease for a vacuum pump, semiconductor fabrication machines and equipments, and aerospace-associated equipments.

EXAMPLES

The present invention is described below by means of examples, which should not be construed as limiting the present invention.

[Liquid Base Oil Component]

The following base oils A to D were used as the liquid base oil component.

Base oil A: poly-α-olefin (PAO: poly-α-olefin synthetic base oil which is a 1-decene polymer, "SpectraSyn 8" manufactured by ExxonMobil)

Base oil B: fatty acid ester (isostearyl neopentyl glycol ester)

Base oil C: silicone oil (dimethyl silicone synthetic base oil, "KF96-100cs" manufactured by Shin-Etsu Chemical Co., Ltd.,)

Base oil D: commercially available multipurpose oil for machine tools made from mineral oil and an S—P extreme pressure agent ("JOMO Lathus 220" manufactured by Japan Energy)

Properties of base oils A to D are shown in Table 1.

TABLE 1

| | | Base oil A | Base oil B | Base oil C | Base oil D |
|---|---|---|---|---|---|
| Type of base oil | | PAO | Fatty acid ester | Silicone oil | Mineral oil (multipurpose SP oil) |
| kinetic viscosity ($mm^2/s$) | 40° C. | 66.0 | 45.9 | 220.0 | 76.6 |
| | 100° C. | 10.0 | 8.10 | 19.0 | 32.0 |
| Viscosity index | | 137 | 150 | 424 | 96 |
| Pour point (° C.) | | −45.0 | −47.5 | −60.0 | −20.0 |

[Amide Compound]

The following two amide compounds, amide A and amide B, were used as a semisolidification agent that is added to a base oil in order to form a semisolid gel.

Amide A: ethylene bisstearic acid amide ("Slipacks E" manufactured by Nippon Kasei Chemical Co., Ltd.), melting point: 145° C.

Amide B: stearyl stearic acid amide ("Nikkamide S" manufactured by Nippon Kasei Chemical Co., Ltd.), melting point: 100° C.

[Thickener]

In order to compare with a commonly-used conventional grease, lithium soap (lithium stearate) and diurea were used as a thickener for preparing a general grease as Comparative Examples.

[Preparation of Semisolid Lubricant Composition]

The semisolid lubricant compositions of the present invention (Examples 1 to 6) were prepared using the above-mentioned liquid base oil components and amide compounds (semisolidication agent) in accordance with the following procedure.

The liquid base oil and the amide compound were weighted in the amount (parts by weight) respectively shown in the upper part of Table 2 into a stainless steel beaker. The mixture was stirred while heating on a desk-top electromagnetic heater at a temperature higher than the melting point of the amide compound (melting point+20° C.) (temperature was measured by a thermocouple) After visually confirming homogeneous dissolution, about 100 ml of the homogeneous solution was poured into a heat resistant glass container (inner diameter: 60 mm, height: 90 mm). The mixture was allowed to cool to obtain a semisolid lubricant composition.

The greases of Comparative Examples 1 and 2 were prepared by weighing the liquid base oil and the thickener (lithium soap and diurea) in amounts (parts by weight) respectively shown in Table 2, and sufficiently kneading the mixture with a kneader.

Comparative Example 3 was just a commercially available multipurpose SP oil for machine tools which contains neither an amide compound nor a thickener.

TABLE 2

| | Example | | | | | | Comparative Example | | |
|---|---|---|---|---|---|---|---|---|---|
| | 1 | 2 | 3 | 4 | 5 | 6 | 1 | 2 | 3 |
| Base oil A | 100 | 100 | 100 | — | — | 100 | 100 | 100 | — |
| Base oil B | — | — | — | 100 | — | — | — | — | — |
| Base oil C | — | — | — | — | 100 | — | — | — | — |
| Base oil D | — | — | — | — | — | — | — | — | 100 |
| Amide A | 10 | 2 | 40 | 10 | 10 | — | — | — | — |
| Amide B | — | — | — | — | — | 10 | — | — | — |
| Thickener Lithium soap | — | — | — | — | — | — | 8 | — | — |
| Thickener Diurea | — | — | — | — | — | — | — | 12 | — |
| Consistency | 271 | 450 | 50 | 280 | 280 | 280 | 279 | 284 | — |
| Consistency number | 2 | 000 | 6 or more | 2 | 2 | 2 | 2 | 2 | — |
| Microfiltration | Filtered | Filtered | Filtered | Filtered | Filtered | Filtered | Not filtered Oil separation | Not filtered Plugging | Filtered |
| Photograph of wear scar | FIG. 1 (a) | — | — | — | — | — | FIG. 1 (b) | FIG. 1 (c) | — |

[Evaluation Method]

The semisolid lubricant compositions (Examples 1 to 6), the grease, and the multipurpose SP oil for machine tools (Comparative Examples 1 to 3) were evaluated by the following performance evaluation tests. The test results of the consistency and the possibility of being filtered by a microfilter are shown in Table 2, and the results of the lubricity evaluation are shown in Table 3.

[Consistency]

Unworked penetration was measured according to JIS K2220 using a ¼ consistency meter. Table 2 shows the measured consistency and the consistency number corresponding to the measured consistency.

[Possibility of Microfiltration]

Whether or not the sample can be filtered by microfiltration was judged and the state of the filtered sample was evaluated. 50 g of the test sample oil was put onto a funnel provided with a microfilter made from polytetrafluoroethylene (manufactured by Membrane Co., Ltd., filter pore size: 5 μm) and allowed to stand in a thermostatic chamber at 150° C. for one hour to allow the sample to be filtered. If a sample cloud be filtered without plugging the microfilter and restored the same state before filtration (semisolid state) after cooling, the sample was judged to be capable of being filtered by microfiltration. If the sample did not pass through the filter due to plugging or if the original homogeneous semisolid state was not restored due to separation of the thickener component from the liquid base oil by filtration (oil separation), the sample was judged to be incapable of being filtered by micro filtration.

[Lubricity]

The sample oils of Examples 1 and 7 and Comparative Examples 1 to 3 were subjected to an abrasion test by a Shell four ball test and the SRV friction test to evaluate lubricity (anti-wear property and coefficient of friction).

The Shell four ball abrasion test was carried out according to ASTM D4172B, in which a cup holder was charged with the sample oil in an amount sufficient to fill out the four balls and the balls were subjected to the following test conditions to determine the wear scar diameter thereof. For the sample oils which were capable of being filtered by microfiltration, the filtered oil obtained by microfiltration was also subjected to the Shell four ball abrasion test.

Example 1

Comparative Examples 1 and 2

Rate: 1200 rpm, oil pressure load: 2.94 MPa (30 kgf/cm$^2$), temperature: room temperature, time: 30 minutes Comparative Example 3

Rate: 1800 rpm, oil pressure load: 3.92 MPa (40 kgf/cm$^2$), temperature: room temperature, time: 30 minutes SRV friction test was carried out using a ball-on disk friction tester equipped with SRV device according to ASTM D5706. The coefficient of friction at steady state (after 30 minutes from commencement) and the wear scar width on the disk after the test were measured by applying 0.5 g of each five sample oils as mentioned above to the surface of the disk (material: SUJ-2), and carried out under the predetermined test conditions (load: 100 N (10.17 kgf/cm$^2$), number of amplitudes: 50 Hz, and the amplitude width: 1.5 mm, temperature: 40° C., time: 30 minutes).

In addition, wear conditions on the surface of the disk were observed using a stereo microscope. The optical microscope photographs are shown in FIG. 1. FIGS. 1(*a*), 1(*b*), and 1(*c*) show photographs of wear scars produced on disks used for the SRV friction test of the lubricant compositions of Example 1, Comparative Example 1, and Comparative Example 2, respectively.

TABLE 3

| | Example | Comparative Example | | |
|---|---|---|---|---|
| | 1 | 1 | 2 | 3 |
| Shell four ball abrasion (mm) | | | | |
| Wear scar diameter on test ball (before filtration) | 0.28 | 0.33 | 0.40 | — |
| Wear scar diameter on test ball (after filtration) | 0.28 | Dissociated after filtration | Not filtered | — |
| Shell four ball abrasion (mm) | | | | |
| Wear scar diameter on test ball (before filtration) | — | — | | 0.41 |

TABLE 3-continued

| | Example | Comparative Example | | |
|---|---|---|---|---|
| | 1 | 1 | 2 | 3 |
| Wear scar diameter on test ball (after filtration) | — | — | | 0.41 |
| SRV friction properties | | | | |
| Coefficient of friction | 0.09 | 0.11 | 0.12 | 0.14 |
| Wear scar width on disk (mm) | 0.28 | 0.38 | 0.48 | 0.36 |

It was possible to produce a semisolid lubricant composition from any of the liquid base oil of Examples 1 to 6 described in Table 2 by adding an amide compound. The lubricant compositions of Examples 1 to 6 had a hardness in the consistency number range of No. 000 to No. 6 or exceeding No. 6. The compositions of Comparative Examples 1 and 2 had a consistency number of No. 2 and the composition of Comparative Example 3 did not show a semisolid state.

When lubricity of the composition of Example 1 and the compositions of Comparative Examples 1 and 2, all of which have a consistency number of No. 2, are compared, the product of Example 1 was confirmed to have a smaller wear scar diameter in the Shell four ball test, indicating superior wear resistance. The results of the SRV test also show that the composition of Example 1 has a low coefficient of friction and only slight scarring of the test balls and the disk (see FIG. 1). Furthermore, all compositions in Examples could be filtered by microfiltration. The filtered compositions restored their original semisolid state after cooling and showed no change in the anti-wear properties.

On the other hand, although the lithium soap grease of Comparative Example 1 could pass through the microfilter, the liquid base oil component and the thickener component dissociated after cooling and the composition did not return to the original state. The urea grease of Comparative Example 2 did not pass through the microfilter, thus microfiltration could not be performed. The multipurpose SP oil for machine tools of Comparative Example 2 could be filtered by microfiltration, but the filtered oil showed inferior anti-wear properties and a higher coefficient of friction as compared with the composition of Example 6.

INDUSTRIAL APPLICABILITY

As described above, the semisolid lubricant composition of the present invention has more excellent lubricity in comparison with general widely-used grease, particularly reduction of anti-wear properties and lowering in friction. If applied to mechanical systems comprising transmission elements such as a gear, a moving screw, a cam, a belt, a chain, a wire rope, and the like as a turbine oil, machine tool oil, metal working oil, forming oil, cutting oil, compressor oil, vacuum-pump oil, electrical-contact oil, or machine oil, the composition is expected to have an energy-saving effect. In addition, because of excellent anti-wear properties, the composition is expected to expand the life of the mechanical systems. Furthermore, the composition can be filtered by a microfilter, which can remove very small pieces of foreign matter contained therein. Therefore, the purified semisolid lubricant composition can be suitably used for applications such as precise mechanical system, particularly electronic devices, and the like, for which a highly refined lubricant composition is required.

The invention claimed is:

1. A semisolid lubricant composition for a transmission element capable of reducing wear of sliding portions of the transmission element, comprising:

an amide compound having one or two amide groups and forming a three-dimensional network structure, the amide compound being at least one compound represented by any one of following formulas (1) to (3) with the content thereof being 0.1 to 70 mass %

$$R^1—CO—NH—R^2 \quad (1)$$

$$R^3—CO—NH-A^1-NH—CO—R^4 \quad (2)$$

$$R^5—NH—CO-A^2-CO—NH—R^6 \quad (3)$$

where $R^1$, $R^3$, $R^4$, $R^5$, and $R^6$ individually represent a saturated or unsaturated linear hydrocarbon group having 5 to 25 carbon atoms, $R^2$ represents hydrogen or a saturated or unsaturated linear hydrocarbon group having 5 to 25 carbon atoms, and $A^1$ and $A^2$ individually represent an alkylene group having 1 to 10 carbon atoms; and a liquid base oil component having a kinetic viscosity at 100° C. of 25 $mm^2/s$ or lower and a viscosity index of 120 or higher, wherein the composition substantially contains no component other than the amide compound, the liquid base oil component, and optionally a polymer having a molecular weight of 1000 or more, with a polymer content being 3 mass % or less.

2. The composition according to claim 1, wherein the amide compound is at least one compound represented by any one of the following formulas (1) or (2)

$$R^1—CO—NH—R^2 \quad (1)$$

$$R^3—CO—NH-A^1-NH—CO—R^4 \quad (2)$$

wherein $R^1$, $R^3$, and $R^4$ individually represent a saturated or unsaturated linear hydrocarbon group having 5 to 25 carbon atoms, $R^2$ represents hydrogen or a saturated or unsaturated linear hydrocarbon group having 5 to 25 carbon atoms, and $A^1$ represents an alkylene group having 1 to 10 carbon atoms.

3. The composition according to claim 1, wherein the liquid base oil component is at least one synthetic oil selected from a poly-α-olefin, a fatty acid ester, or a silicone oil.

4. The composition according to claim 1, wherein the transmission element is at least one transmission element selected from a gear, a moving screw, or a chain.

5. A mechanical system comprising at least one transmission element selected from a gear, a moving screw, or a chain provided with the composition according to claim 1 in a sliding portion thereof.

6. A mechanical system comprising at least one transmission element selected from a gear, a moving screw, or a chain provided with the composition according to claim 1 in a sliding portion thereof.

7. A mechanical system comprising at least one transmission element selected from a gear, a moving screw, or a chain provided with the composition according to claim 2 in a sliding portion thereof.

8. A mechanical system comprising at least one transmission element selected from a gear, a moving screw, or a chain provided with the composition according to claim 3 in a sliding portion thereof.

9. A mechanical system comprising at least one transmission element selected from a gear, a moving screw, or a chain provided with the composition according to claim 4 in a sliding portion thereof.

10. The composition according to claim 1, wherein the compound of formula (1) is selected from the group consisting of lauric acid amide, palmitic acid amide, stearic acid amide, behenic acid amide, hydroxy stearic acid amide, oleic acid amide, erucic acid amide, stearyl stearic acid amide and oleyl oleic acid amide.

11. The composition according to claim 1, wherein a melting point of the compound of formula (1) is from 50° C. to 200° C.

12. The composition according to claim 1, wherein the compound of formula (2) is selected from the group consisting of ethylene bisstearic acid amide, ethylene bisisostearic acid amide, ethylene bisoleic acid amide, methylene bislauric acid amide, hexamethylene bisoleic acid amide, hexamethylene bishydroxy stearic acid amide, and m-xylylene bisstearic acid amide.

13. The composition according to claim 1, wherein the compound of formula (3) is N,N'-distearic sebacic acid amide.

14. A semisolid lubricant composition, comprising:

an amide compound having one or two amide groups and forming a three-dimensional network structure, the amide compound being at least one compound represented by any one of following formulas (1) to (3) with the content thereof being 0.1 to 70 mass %

$$R^1—CO—NH—R^2 \quad (1)$$

$$R^3—CO—NH\text{-}A^1\text{-}NH—CO—R^4 \quad (2)$$

$$R^5—NH—CO\text{-}A^2\text{-}CO—NH—R^6 \quad (3)$$

where $R^1$, $R^3$, $R^4$, $R^5$, and $R^6$ individually represent a saturated or unsaturated linear hydrocarbon group having 5 to 25 carbon atoms, $R^2$ represents hydrogen or a saturated or unsaturated linear hydrocarbon group having 5 to 25 carbon atoms, and $A^1$ and $A^2$ individually represent an alkylene group having 1 to 10 carbon atoms; and a liquid base oil component having a kinetic viscosity at 100° C. of 25 $mm^2/s$ or lower and a viscosity index of 120 or higher, wherein the composition substantially contains no component other than the amide compound and the liquid base oil component.

15. The composition according to claim 14, wherein the amide compound is at least one compound represented by any one of the following formulas (1) or (2)

$$R^1—CO—NH—R^2 \quad (1)$$

$$R^3—CO—NH\text{-}A^1\text{-}NH—CO—R^4 \quad (2)$$

where $R^1$, $R^3$, and $R^4$, individually represent a saturated or unsaturated linear hydrocarbon group having 5 to 25 carbon atoms, $R^2$ represents hydrogen or a saturated or unsaturated linear hydrocarbon group having 5 to 25 carbon atoms, and $A^1$ represents an alkylene group having 1 to 10 carbon atoms.

16. The composition according to claim 14, wherein the liquid base oil component is at least one synthetic oil selected from a poly-α-olefin, a fatty acid ester, or a silicone oil.

17. The composition according to claim 14, wherein the compound of formula (1) is selected from the group consisting of lauric acid amide, palmitic acid amide, stearic acid amide, behenic acid amide, hydroxy stearic acid amide, oleic acid amide, erucic acid amide, stearyl stearic acid amide and oleyl oleic acid amide.

* * * * *